US006158309A

United States Patent [19]

Baker

[11] Patent Number: 6,158,309

[45] Date of Patent: Dec. 12, 2000

[54] DOUBLE-DRIVE DOUBLE-LOCK RATCHETING WRENCH

[75] Inventor: David R. Baker, Fort Worth, Tex.

[73] Assignee: David Baker, Inc., Fort Worth, Tex.

[21] Appl. No.: 09/176,591

[22] Filed: Oct. 21, 1998

[51] Int. Cl.[7] ..... B25B 13/02

[52] U.S. Cl. ..... 81/119; 81/124.3; 81/186

[58] Field of Search ..... 81/119, 124.3, 81/124.7, 186

[56] References Cited

U.S. PATENT DOCUMENTS

| | | | |
|---|---|---|---|
| 2,652,735 | 9/1953 | Wilder | 81/119 |
| 3,881,377 | 5/1975 | Evans et al. | 81/119 X |
| 4,889,020 | 12/1989 | Baker . | |
| 5,239,899 | 8/1993 | Baker . | |
| 5,381,710 | 1/1995 | Baker . | |
| 5,582,083 | 12/1996 | Baker | 81/119 |

FOREIGN PATENT DOCUMENTS

| | | | |
|---|---|---|---|
| 2231588 | 6/1972 | Germany | 81/119 |

*Primary Examiner*—David A. Scherbel
*Assistant Examiner*—Anthony Ojini
*Attorney, Agent, or Firm*—Felsman, Bradley, Vaden, Gunter & Dillon, L.L.P.; James E. Bradley

[57] ABSTRACT

An ratcheting-type wrench for use in driving a hexagonal nut having a wrench head. The wrench head has upper and lower jaw portions that are rigidly joined by at least one web. The jaws have several faces that allow the wrench to be ratcheted about the nut to different drive positions without removing the wrench from the nut. The jaws have two drive faces that allow the wrench to drive the nut with the wrench tips in an open-ended embodiment, and in both an open-ended and a box-ended embodiment allow the wrench to ratchet in 30 degree increments. The faces are configured to prevent corner contact with the nut so that the corners are not rounded off. A lock face is provided to prevent the removal of the wrench from the nut while applying torque.

19 Claims, 4 Drawing Sheets

DOUBLE-DRIVE DOUBLE-LOCK RATCHETING WRENCH

TECHNICAL FIELD

This invention relates in general to wrenches, and in particular, to open-ended and box-type wrenches having ratcheting action.

BACKGROUND ART

In a conventional open-end wrench, a rigid jaw is joined to a shank. The jaws have parallel faces that slide over the sides of the nut. After each stroke, the user must remove the wrench from the nut and reposition it on the nut. Typically the nut is hexagonal, with a point or corner every 60°. Because of the necessary clearances required to fit the wrench over the nut, the wrench actually contacts the nut at the corners. This to round the corners of the nut, particularly when high torque is required.

A number of patents have issued disclosing open-end wrenches that will ratchet. That is, the user is able to reposition the wrench on the nut for another stroke without having to completely remove the wrench from the nut. The designs have various deficiencies. Many of them drive only on the corners of the nut, tending to round the corners off. They also usually require that the wrench be pulled away from the nut with each repositioning stroke so that the next position is not self-seeking. A wrench that is self seeking has the characteristics of ratcheting from one driving position to the next while being held in contact with the nut. This self seeking characteristic would be due entirely to the design of the various surfaces, faces, points and angles of the wrench in relation to the nut to be turned, and would not require special positioning of the wrench by the user.

Another problem with prior art wrenches is that there is the potential for the wrench to slide off the nut during torque. This is particularly true when high torque is being applied. When this occurs, the user may scrape or injure his hand, particularly when the wrench is being used in confined areas. Notches formed in the drive faces in non-ratcheting-type wrenches have been used in the past to hold the wrench in place on the nut during torque, but not in a 60° self-seeking ratchet-type wrench, or even more particularly, in a60° self-seeking ratchet-type wrench that also has a 30° incremental drive function. Many of the prior art ratcheting wrenches must also drive the nut with the wrench full engaging the nut. This may become a problem when space constraints prevent the full wrench head from fitting around the nut.

SUMMARY OF THE INVENTION

A wrench of this invention is a ratcheting-type wrench for use in driving a hexagonal nut. The wrench comprises upper and lower jaw portions that are rigidly joined together. The jaw portions are immovable and adapted to accept a hexagonal nut. There is an upper primary drive face located on the upper jaw portion. The primary drive face is adapted to contact a first side of a nut when the wrench is in a primary drive position. An upper backstop face adjoins the upper primary drive face. The backstop face is adapted to coextend generally along length of a second side of the nut when the wrench in the primary drive position. A lower backstop face adjoins the upper backstop face and is adapted to generally coextend along a third side of the nut adjacent to the second side. The lower backstop face is adapted to be spaced apart from the third side of the nut when the wrench is in the primary drive position. A lower jaw face adjoins the lower backstop face and is adapted to generally coextend along an opposite side of the nut from the first side when the wrench is in the primary drive position. A notch adjoins the lower jaw face forward of the lower primary drive face for engaging a corner of the nut. A clearance face is located on the upper jaw portion forward of the upper primary drive face. An upper secondary drive face is located on the upper jaw portion forward of the clearance face. A lower secondary drive face is located on the lower jaw portion forward of the notch. A catch face is located on the lower jaw portion forward of the secondary drive face for contacting a side of the nut opposed to the second side of the nut when the wrench is in the secondary drive position.

BEST MODE FOR CARRYING OUT THE INVENTION

Figure 1:
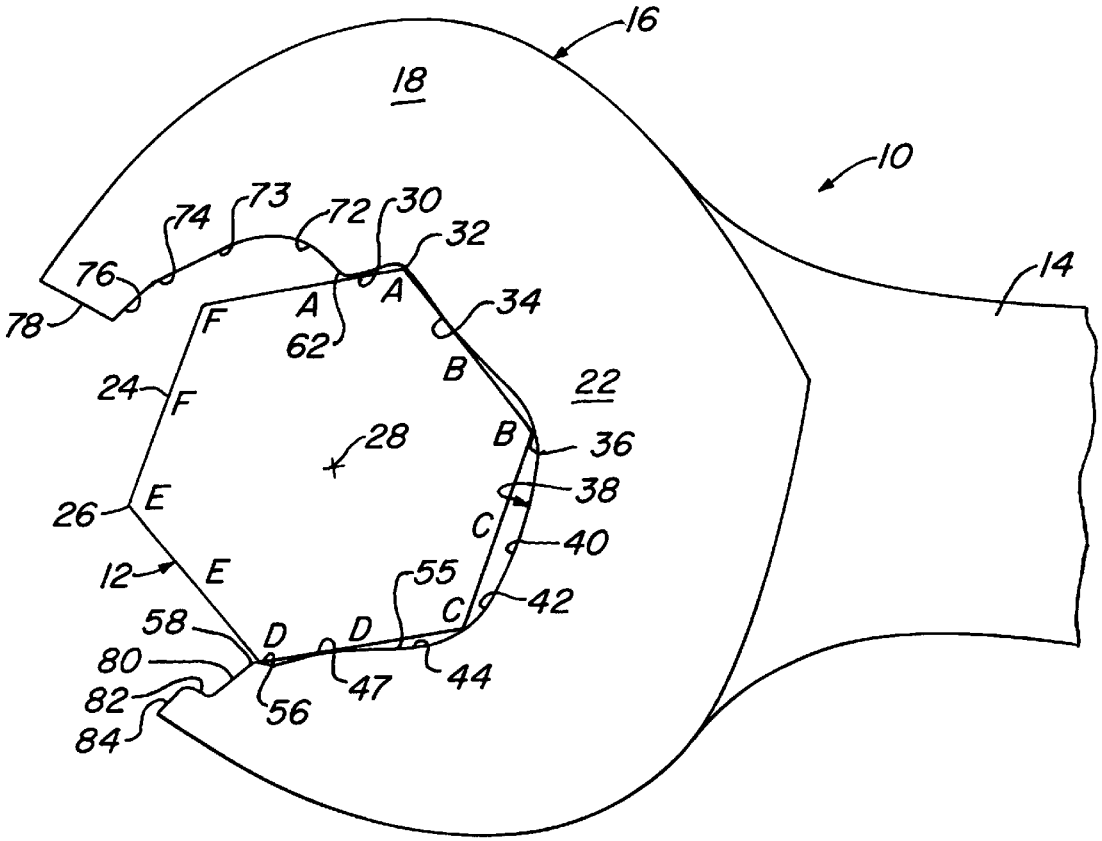
FIG. 1 is a top plan view of a ratchet-type, open-end wrench shown engaged with a nut in a primary drive position and constructed in accordance with the invention.

Referring to the figures, a ratcheting-type wrench 10 is shown for use with a conventional hexagonal nut or bolt head 12. The wrench 10 has a shaft or handle 14 to which a wrench head 16 is integrally formed. The wrench head 16 has upper and lower jaw portions 18, 20 that are spaced apart and joined together on at least one end by a web 22.

FIG. 1 shows the wrench head 16 engaged with the nut 12 in a primary drive position, with the wrench head 16 oriented at a zero degree approach angle. Unless otherwise stated, specific dimensions given for the wrench head are for use with hexagonal nuts where the maximum nut size is two inches as measured from flat to flat. References to the nut and relative positions are also with respect to the maximum size nut. Such references and dimensions are given for ease of description and understanding purposes only and should in no way be construed as limitations. It should be readily apparent to those skilled in the art that these dimensions will vary from wrench to wrench depending on the size of the nut it is designed for. The nut 12 has six flats 24 with adjacent flats intersecting at approximately 120° to form corners 26. The individual flats 24 and corners 26 are each designated with an A,B,C,D,E or F for ease of description. Each corner 26 is located an equal distance from a center point 28 of the nut 12.

Figure 2:
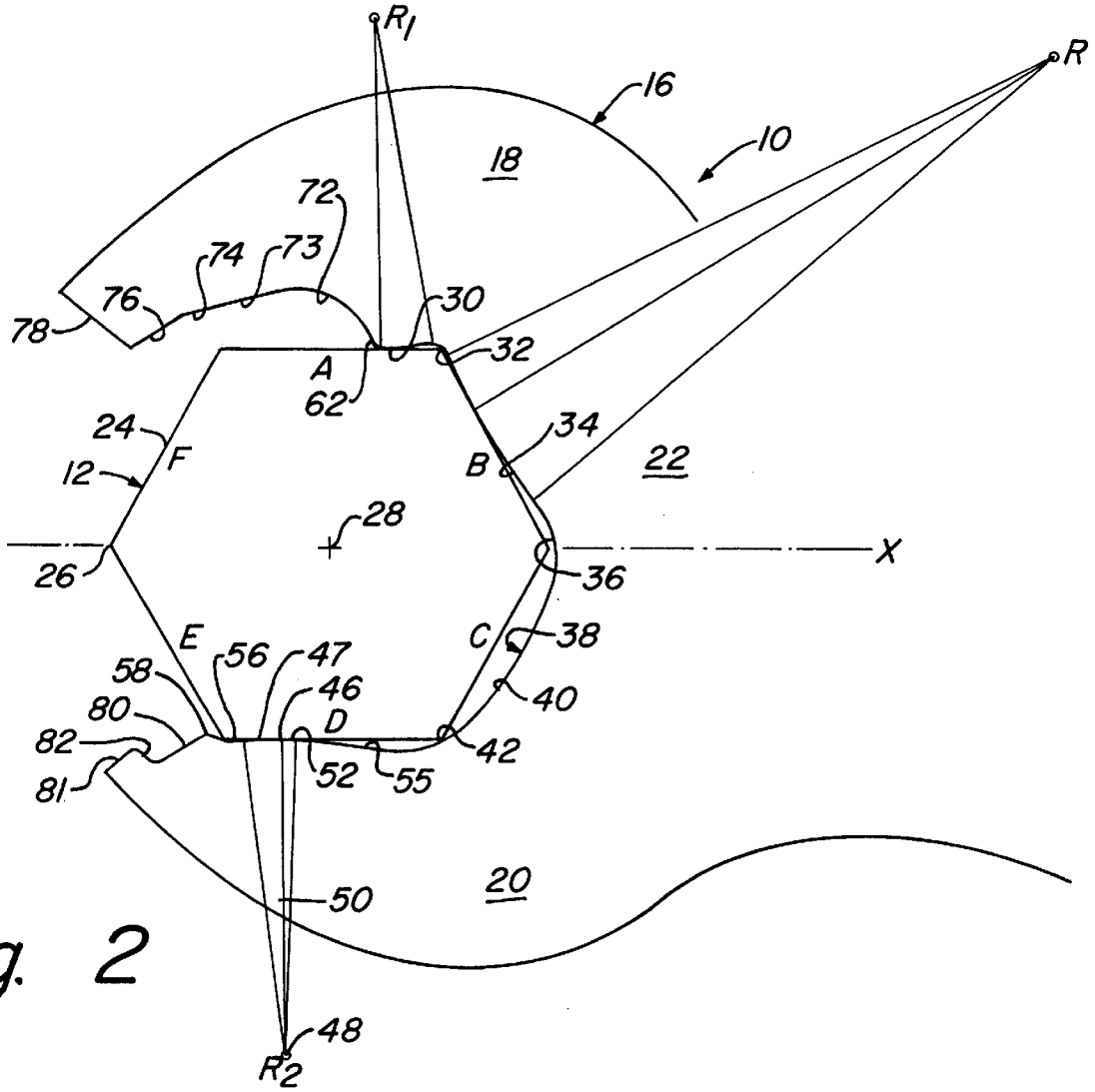
FIG. 2 is another top plan view of the wrench of FIG. 1, shown engaged with a nut having maximum dimensions and in the primary drive position.

The wrench head 16 is provided with a jaw construction that allows the wrench 10 to be used in a primary drive and a secondary drive mode. The jaw faces used in the primary drive mode are constructed generally the same as those described for the wrench head in pending U.S. patent application Ser. No. 08/902,540, filed Jul. 22, 1998, entitled Sixty-Degree Ratchet Wrench, which is herein incorporated by reference in its entirety. Located on the upper jaw 18 is a primary upper drive face 30. Referring to FIG. 2, with the nut 12 and wrench head 16 in the primary drive position, the primary drive face 30 extends a distance along the flat 24A forward from the corner 26A a distance defined by an angle H of 13 to 16° extending forward from the corner 26A, as measured from the center point 28 of the nut 12 when the nut 12 is in the primary drive position. The center point 28 of the nut 12 is located on an axis X that bisects the wrench head 16 when in the primary drive position. The curvature and shape of the faces described is the substantially the same through any cross section of the wrench head 16 throughout its thickness. The primary upper drive face 30 is a convex arcuate surface with the forward portion of the primary drive surface having a single radius of curvature $R_1$ of about 0.875×N, where N is the maximum width of the nut 12 to be driven. The drive face 30 merges with a concave fillet 32 that provides a clearance so that the corner 26A does not touch the wrench head 16 when in the primary drive position.

Extending from the primary upper drive face 30 is an upper backstop face 34 that is joined to the drive face 30 by means of the fillet 32. The backstop 34 extends along the nut flat 24B from corner 26A to 26B. The backstop 34 is a convex curved surface having a single radius of curvature of about 1.75×N which converges smoothly with fillet 32 at one end and a fillet 36 at the other end. The apex of the backstop 34, where the backstop 34 contacts or is tangential to the nut flat 24B, is located at a position above the center of the backstop 34. On a wrench designed for a two-inch nut, for example, this apex may be located 0.464 inches, or 0.232×N from the corner 26A.

The fillet 36 is a concave curve having a radius of curvature of about 0.4820 inches or 0.241×N. As shown in FIGS. 1 and 2, the fillet 36 is configured so that the corner 26B does not touch the wrench head 16 when in the primary drive position.

Joined to the upper backstop 34 by means of the fillet 36 is a lower backstop face 38. The lower backstop 38 generally coextends with the nut flat 24C from corner 26B to 26C when the nut is in the primary drive position. The lower backstop 38 is a concave surface having a single radius of curvature. A suitable radius of curvature is about 2.356×N. The lower backstop 38 should be offset a distance from the nut flat 24C so that the nut 12 does not come into contact with the backstop face 38 at any time. The lower backstop face 38 is joined to a concave fillet 42 at the other end. The fillet 42 has a single radius of curvature of about 0.4820 inches or 0.241×N. As shown in FIGS. 1 and 2, the corner 26C is tangential to the fillet 42 and may just touch at the approximate center of the fillet 42. This may not always be the case in actual use, however, as worn nuts with rounded corners may not touch fillet 42 when in the drive position, nor will any nut of a given size that is less than ANSI maximum manufactured size, known as "nominal size."

A lower jaw face 44 is joined to the lower backstop 38 and extends along the nut flat 24D between corner 26C and 26D, as shown in FIG. 1. Extending forward beginning at a point 46 (FIG. 2) located between 13 to 17° rearward from the corner 26D, which is tangential to the nut flat 26D, the lower jaw face 44 is a convex arcuate surface 47, which forms a lower primary drive face having a single radius of curvature $R_2$ of between about 0.75×N to about 1.25×N, depending on the nut size to be driven and that nut's allowed manufacture tolerance. This lower primary drive face 47 extends forward along the lower jaw face 44 from the point 46 a distance defined by an angle I of about 7°, where the angle I has a point of convergence 48 located along a line 50 extending perpendicular outward at point 46 from the nut flat 24D at a distance equal to $R_2$. The point 46 constitutes an apex of the lower drive face 47. The vertical distance between the lowermost point or apex of the upper primary drive face 30 and the uppermost point or apex 46 of the lower primary drive face 47 should be equal to the maximum nut width or N.

Rearward from point 46 on the lower jaw face 44 the surface is a convex curved surface 52 also having radius of curvature $R_2$ that slopes downward from point 46, away from the nut flat 24D for a distance measured by the angle J having its point of convergence at point 48, as measured from the line 50. The angle J is approximately 3°.

Extending rearward from the area 52 is a slide face 55 that is a flat plane that is sloped downward 3.5 to 5° from the adjacent nut flat 24D when in the primary drive position. The measurement T is the distance along a line extending between the apex of the drive face 30 and that point on the slide face 55 where the line T is perpendicular. The measurement T is slightly greater than the maximum side-to-side diameter of the nut 12. The "T" dimension needed to ratchet a nominal size nut is about 1.014×N. For a two-inch nut, for example, an adequate distance has been found to be about 2.0278 inches. This clearance allows the wrench 10 to be rotated about the nut 12 during ratcheting.

Extending forward from the lower primary drive face 47 is a lock face or notch 56. The lock face 56 may be formed as a single flat plane or a slight concave curve that slopes upward generally from the lower drive face 47 at an angle of between 15 to 20°, relative to the nut flat 24D or a line drawn tangent to point 46. Alternatively, the lock face 56 may be an arcuate concave curved surface (FIG. 2) at its rearward end having a radius of curvature of about 1.5×N, with a flat forward end.

A flat 58 extends forward from the lock face 56 and is parallel and slightly above the nut flat 24D about 0.0112×N, with the vertical distance between the forward most end of the lock face 56 and the upper primary drive face 30 being less than the side-to-side diameter of the nut 12. The portion 58 has a length of about 0.015×N. Although the wrench head 16 is shown with the portion 58 as a flat plane, it may also be arcuate with a slight convex curve. The portion 58 drives the lower nut flat 24D when the wrench is at high angles of approach.

Extending forward from the upper primary drive face 30 on the upper jaw 18 is a flat 62 that is oriented at an angle of about 25° from the nut flat 24A. The flat 62 has a length of about 0.05 inches or 0.025×N. This may be a slight convex curve also.

A secondary drive portion of the wrench head 16 is located forward of the primary drive portion. The secondary drive portion of the upper jaw 18 has a concave clearance face 72 that extends forward from the flat 62. The clearance face 72 has a radius of curvature of about 0.256×N. The measurement S is the greatest vertical distance from the nut flat 24A, when in the primary drive position, to the clearance face 72 and is approximately 0.15×N. The clearance face 72 curves forward and eventually flattens out into flat portion 73 that junctions with the corner 26F (FIG. 3) of the nut 12 when in the secondary drive position. The flat portion 73 has a length of about 0.3385 inches or 0.1692×N. The flat portion 73 merges with an upper secondary lock face 74.

Figure 3:
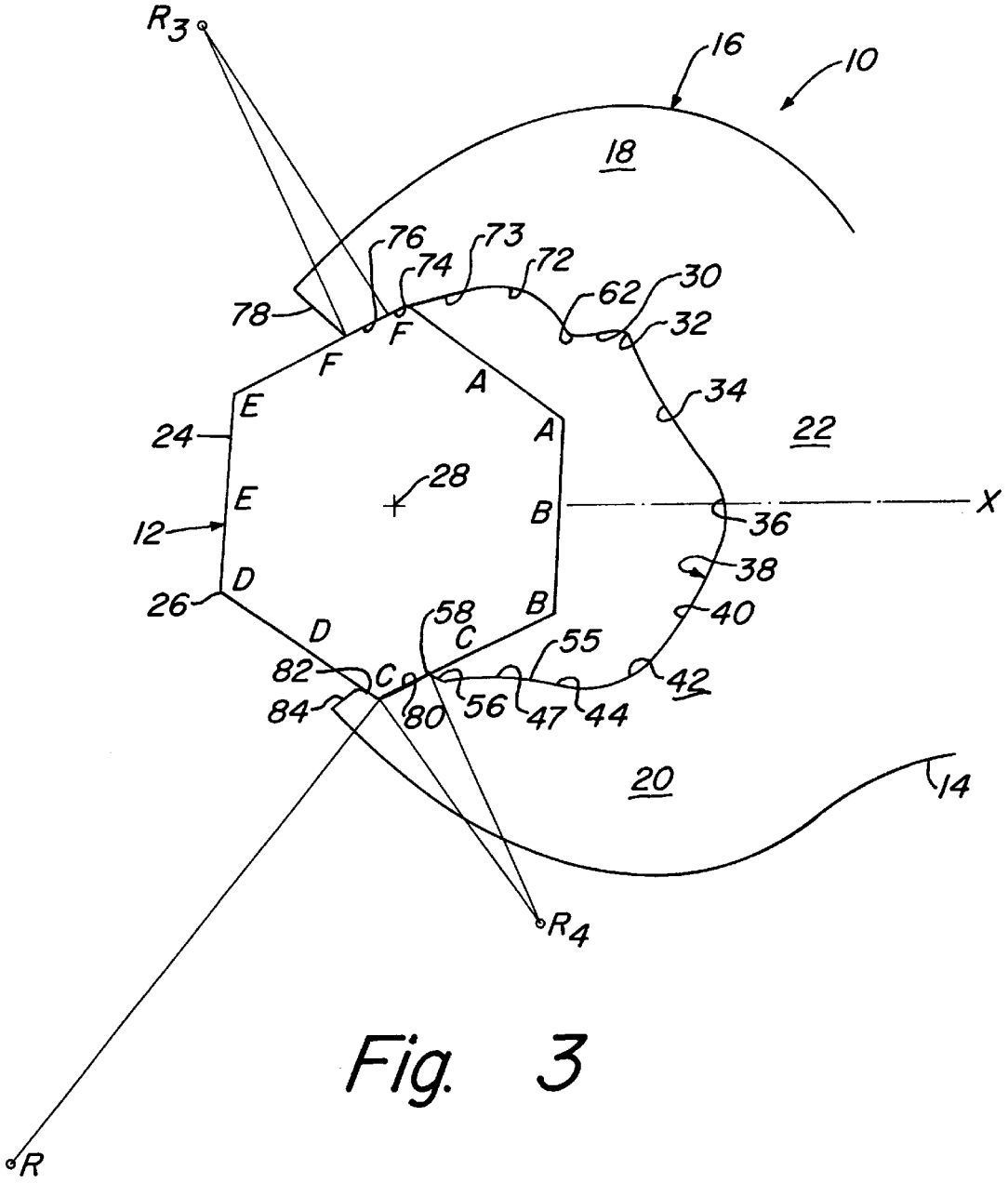
FIG. 3 is a top plan view of the wrench of FIG. 1, shown with a nut in a secondary drive position.

FIG. 3 shows the nut 12 in a secondary drive position. When in the secondary drive position, the nut 12 is positioned with the center point 28 of the nut 12 still located on the X axis but at a distance of about 0.8375 inches or 0.41875×N forward from the center 28 of the nut 12 when it is in the primary drive position. The nut 12 is positioned between the jaws 18, 20, with nut flat 24F at an angle of about 25° relative to the nut flat 24A (FIG. 2) when it is in the primary drive position. The lock face 74 is a flat plane oriented at an angle of about 14° from the nut flat 24F when in the secondary drive position and extends across the nut corner 26A, sloping downward toward the rearward end.

An upper secondary drive face 76 is located forward and joined to the upper secondary lock face 74. The drive face 76 extends along the nut flat 24F and terminates at a forward position of approximately 15 to 22° forward of the corner 26F, as measured from the center 28 of the nut 12, when in the secondary drive position. The upper secondary drive face 76 is a convex arcuate surface having a radius of curvature $R_3$ of approximately 1×N. The rearward end of the upper secondary drive face 76 intersects and joins the forward end of the lock face 74. An end face 78 joins the upper secondary drive face 76 and is a flat plane oriented at an angle of about 66° from the nut flat 24F when in the secondary drive position.

The secondary drive portion of the lower jaw 20 has a lower secondary drive face 80 extending forward and joined to the flat 58. The secondary drive face 80 is a convex arcuate surface having a radius of curvature $R_4$ of about 0.812×N. The lower secondary drive face 80 extends along the nut flat 24C rearward from the corner 26C a distance measured by an angle of 15° from the center 28 of the nut 12, when in the secondary drive position.

Joined to the forward end of the lower secondary drive face 80 is a catch face 82. The catch face 82 extends along the nut flat 24D from the corner 26C a distance of about 0.114 inches or 0.057×N. The catch face 82 may be a flat surface or a convex arcuate surface. A suitable radius of curvature for the catch face 82 is about 1.75×N.

The lower jaw 20 terminates in a lower end face 84. The lower end face 84 is a flat surface oriented at an angle of about 64.5° from the nut flat 24D when in the secondary drive position.

Figure 4:
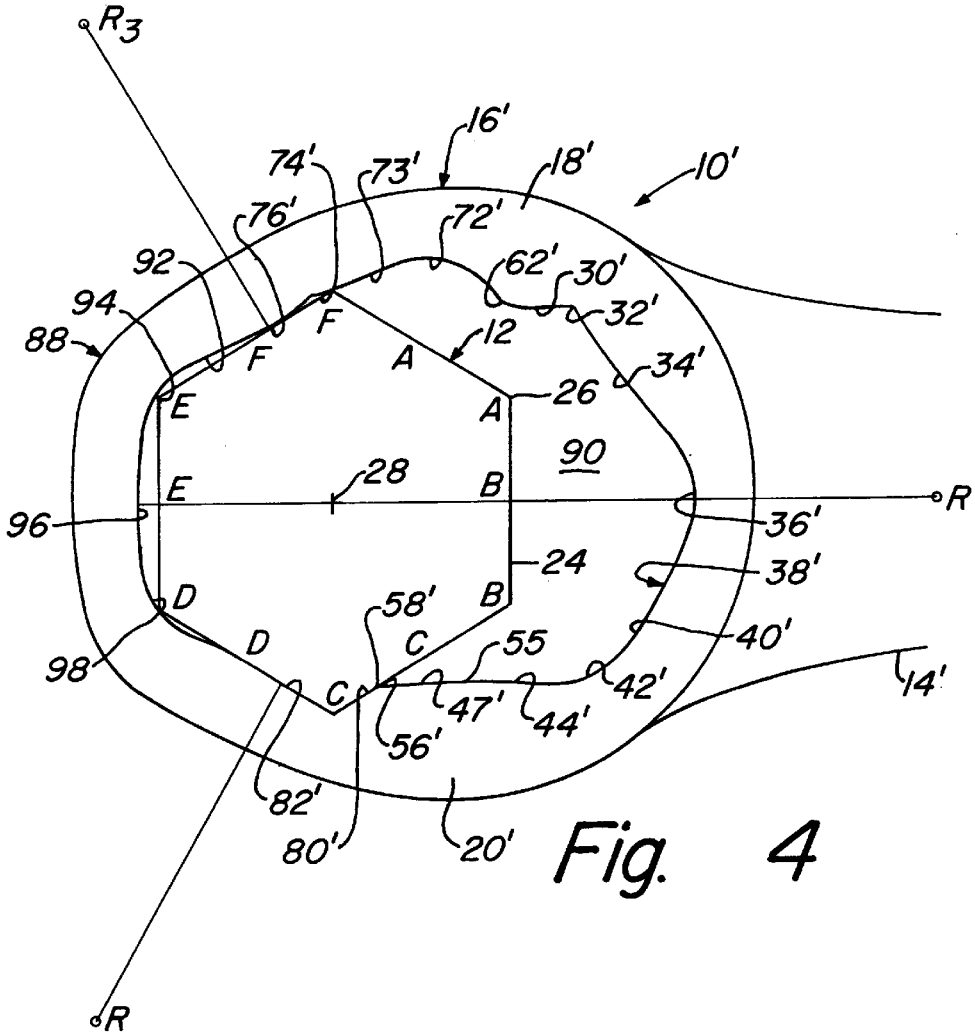
FIG. 4 is a top plan view of a box-type ratcheting wrench shown engaged with a nut and constructed in accordance with the invention.

FIG. 4 shows a box wrench 10'. The construction of the box wrench 10' is generally the same as that of the open-end wrench 10, except that the box wrench 10' is provided with a box-end portion 88 at the forward end that closes off the jaws 18', 20' to form opening 90. Similar elements of the box-end wrench 10' are designated by the same reference numerals as that of wrench 10 with an additional prime symbol.

In the box wrench 10', the end faces 78, 80 are eliminated. The upper secondary drive face 76 is joined by an upper forward stop face 92. The forward stop face 92 is a generally flat surface that extends along the nut flat 24F at an angle of about 6° when the nut 12' is in the secondary drive position. The forward stop face 92 merges with a concave fillet 94 that provides a clearance for nut corner 26E.

Joined to the fillet 94 is a concave arcuate box end face 96. The end face 96 is spaced from the nut 12' and has a radius of curvature of about 2.25×N. The end face 96 extends along the nut flat 24F when in the secondary drive position and merges with concave fillet 98. The concave fillet 98 provides a clearance for nut corner 26D when in the secondary drive position.

The concave fillet 98 joins the catch face 82', which extends along the length of the nut flat 24D when in the secondary drive position, as shown in FIG. 4, instead of terminating adjacent to the corner 26C. The catch face 82' has the same radius of curvature as that for the catch face 82 of open-end wrench 10. The forward stop face 92 and box end face 96 make up a ring portion that joins upper jaw 18' with lower jaw 20'.

The operation of the wrench 10 is as follows. The operation of wrench 10' is generally the same. Initially, the wrench head 16 is slid over the nut 12, with the wrench 10 rotated counter clockwise at an angle of about 7° to 30° relative to the nut 12 from what is shown in FIG. 1, where the nut 12 is in the drive position. In this way, a slight clearance is provided TV between the flat 62 of the upper jaw 18 and the lock face 56 of the lower jaw 20 to allow passage of the nut 12 between the jaws 18, 20. As the nut 12 is slid rearward, the nut flat 24B will eventually contact the upper backstop 34. Further rearward movement of the wrench 10 in relation to the nut 12 is thus prevented.

With the nut flat 24B in contact with the backstop 34, the wrench 10 can then be rotated clockwise until the wrench head 16 and nut 12 are in the primary drive position, as shown in FIG. 1. While this is being done, the nut flat 24B should be maintained in contact with the back stop 34. When in the primary drive position, the upper primary drive face 30 bears against the rearward portion of the nut flat 24A, and the lower primary drive face 47 bears against forward portion of the nut flat 24D for maximum torque. The wrench 10 can then be rotated downward or clockwise to either loosen or tighten the nut 12.

When the wrench 10 is pulled directly rearward relative to the nut 12 from the primary drive position, the nut corner 26D will contact the lock face 56. Because the vertical distance between the lock face 56 and the upper drive face 30 is slightly less than the width of the nut 12, the sloped lock face 56 essentially wedges the nut between the lock face 56 and upper primary drive face 30 to prevent further rearward movement of the wrench head 16 relative to the nut 12. In this way, the wrench 10 is locked onto the nut 12 to help prevent the wrench 10 from slipping off the nut 12 during use. It should be noted that the wrench head 16 of FIG. 2 is shown with a maximum sized nut, so that both the drive and locked positions are essentially the same.

The wrench 10 can be repositioned on the nut 12 in 60° increments for further tightening or loosening, without the removal of the wrench head 16 from the nut 12. This is accomplished by rotating the wrench 10 counter clockwise relative to the nut 12, while forcing the wrench 10 slightly forward to maintain constant contact with the nut 12. Initially, the nut corner 26C will slide from the fillet 42 across the lower jaw face 44. As this is occurring, the nut face 24B and nut corner 26A will slide across the upper backstop 34. The offset lower backstop 38 never contacts the nut 12, facilitating ease of rotation. With continued rotation, the nut corner 26C will eventually contact the lock face 56. The wrench 10 is further rotated with the upper end portion 64 sliding across the nut flat 24A and over corner 26F. With slight forward pressure being exerted on the wrench 10 against the nut 12, when the upper end portion 64 is slid over the corner 26F, the nut 12 and wrench head 16 will naturally position themselves in a new drive position. In this way, continued tightening or loosening of the nut can be achieved.

Figure 5:
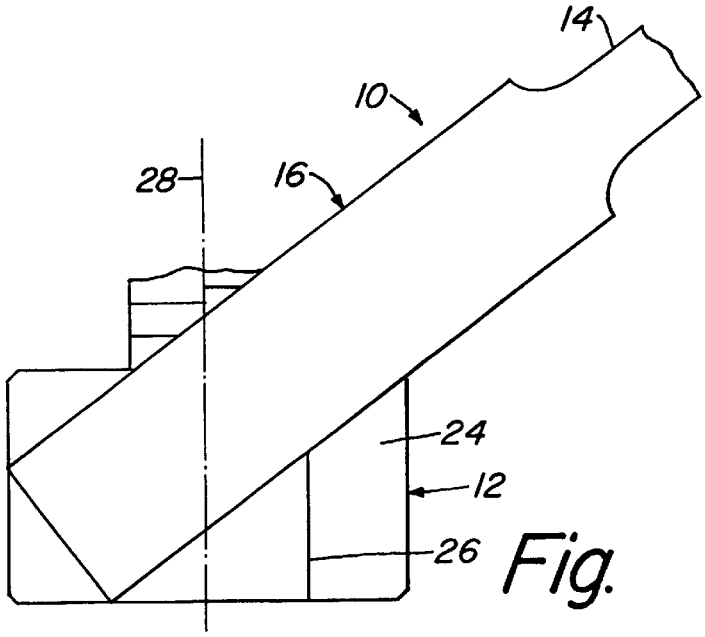
FIG. 5 is a side view of the wrench and nut of FIG. 1, shown with the wrench at a 35° approach to the nut.

The jaw design allows the wrench 10 to be locked on and ratcheted at steeper angles of approach than have prior art open-end ratcheting wrenches. The angle of approach is more clearly illustrated in FIG. 5. Here the angle of approach of the wrench 10 with the nut 12 is at 35°. The wrench 10 remains locked on up to angles of 35°. Driving and ratcheting at angles up to 45° can be achieved with the wrench design. It is preferred, however, that the wrench be used at an angle of approach between 0 to 25°.

To utilize the secondary drive position, with the nut 12 initially in the primary drive position, the wrench 10 is rotated counter clockwise slightly so that the nut 12 can be passed between the flat 62 of the upper jaw 18 and the lock face 56 of the lower jaw 20. As the wrench 10 is rotated further counter clockwise, approximately 300 from the primary drive position, it is moved rearward so that the upper secondary drive face 76 engages the nut flat 24F, and the nut flat 24D engages the catch face 82. This prevents further rearward movement of the wrench 10 on the nut 12. By rotating the wrench 10 clockwise slightly, the wrench head 16 will naturally be positioned in the secondary drive position, with the upper secondary drive surface engaging the nut flat 24F, and the lower secondary drive surface 80 engaging the nut flat 24C, as shown in FIG. 3. The nut 12 can then be rotated clockwise for tightening or loosening.

When the wrench head 16 and nut 12 are in the secondary drive position, direct forward movement of the wrench head 16 is prevented by the lock face 74 and lower drive face 80. Direct rearward movement is prevented by the catch face 82 and upper secondary drive face 76. In this way, the wrench head 16 is securely fixed on the nut 12 when under torque in the secondary drive position.

To reposition the wrench head 16 from the secondary drive position, the wrench head 16 is rotated counter clockwise so that the wrench head 16 pivots about nut flat 58 and the corner 26F is clear of the lock face 74. The wrench head 16 is then moved forward and rotated counter clockwise about 30° from the secondary drive position until the wrench head 16 can be rotated about the nut 12 and moved into the primary drive position, as shown in FIG. 1.

The nut 12 can thus be rotated in approximately 30° increments by moving the wrench head 16 back and forth between the primary and secondary positions. This is helpful when there is little clearance for the handle 14 to be rotated a full 60°.

The wrench 10' is operated in the same manner. The box-end portion 88 merely prevents the nut 12 from slipping out of the jaws 18', 20', as may occur in an open-end wrench.

The wrench design of the invention provides several significant advantages. When the wrench head and nut are in either the primary or secondary drive positions, there is not corner contact with any wrench drive surfaces. Thus, there is no rounding of f or wearing of the nut corners. The arcuate drive faces also compensate for variations in nut and wrench manufacturing tolerances, while still maintaining contact on the nut flats. The drive faces are positioned on the nut flats for maximum toque. When the wrench is in place on the nut and held toward the nut, it will automatically assume a primary drive or ratchet position due to its geometry when rotated on the nut in either the ratchet or drive direction. The lock face design in both drive positions prevents the wrench from being pulled off the nut during use while also allowing a steeper angle of approach to be used in ratcheting and driving the nut than in prior art wrenches. The secondary drive position is out of phase from the first by approximately 30°, thus the wrench can ratchet in 30° increments. Further, the secondary drive position allows the nut to be driven with the wrench tips and thus the wrench of this invention can be used where space constraints do not allow full engagement in the primary drive position. The notches or indentations resist the wrench from being moved on the nut in forward or rearward directions in either drive position while under drive loads.

While the invention has been shown in some of its forms, it should be apparent to those skilled in the art that it is not so limited but is susceptible to various changes without departing from the scope of the invention.

I claim:

1. A ratcheting-type wrench for use in driving a hexagonal nut, the wrench comprising:

upper and lower jaw portions that are rigidly joined together, the jaw portions being immovable and adapted to accept a hexagonal nut;

an upper primary drive face located on the upper jaw portion for contacting a first side of the nut when the wrench is in a primary drive position;

an upper backstop face that adjoins the upper primary drive face for contacting a second side of the nut adjacent to the first side when the wrench is in the primary drive position, the upper backstop face adapted to coextend generally along the length of said second side of the nut when in the primary drive position;

a lower backstop face that adjoins the upper backstop face and is adapted to generally coextend along a third side of the nut adjacent to the second side, the lower backstop face adapted to be spaced apart from the third side of the nut when the wrench is in the primary drive position;

a lower jaw face that adjoins the lower backstop face, the lower jaw face adapted to generally coextend along an opposite side of the nut from the first side when the wrench is in the primary drive position for contacting said opposite side of the nut when in the primary drive position;

a notch that adjoins the lower jaw face forward of the lower primary drive face for engaging a corner of the nut, the lock face having an arcuate concave surface to resist inadvertent disengagement of the wrench from the nut while torque is being applied in a primary drive position;

a clearance face located on the upper jaw portion forward of the upper primary drive face, the clearance face being concave to clear a corner of the nut when the wrench is being ratcheted on the nut;

an upper secondary drive face located on the upper jaw portion forward of the clearance face for contacting the first side of the nut when the wrench is in the secondary drive position;

a lower secondary drive face located on the lower jaw portion forward of the notch for contacting an opposite side of the nut from the first side when the wench is in the secondary drive position; and a catch face located on the lower jaw portion forward of the secondary drive face for contacting a side of the nut opposed to the second side of the nut when the wrench is in the secondary drive position.

2. The wrench of claim 1, wherein:

the lower primary drive face is convex, arcuate and has an apex; and the notch has a forward portion that slopes upward generally at an angle of less than about 20° relative to a line tangent to the apex of the lower drive face.

3. The wrench of claim 1, wherein:

the drive faces are convex arcuate.

4. The wrench of claim 1, wherein:

the upper backstop face is convex, arcuate, and has an apex located at a position above a midpoint of the upper backstop face.

5. The wrench of claim 1, wherein:

the lower jaw face has a rearward portion that joins the lower primary drive face and which is a slide face that is inclining downward relative to an axis bisecting the upper and lower jaw portions.

6. The wrench of claim 5, wherein:

the slide face is a flat surface.

7. The wrench of claim 5, wherein:

the slide face is a concave arcuate surface.

8. The wrench of claim 1, further comprising:

a secondary locating face located on the upper jaw portion forward of the clearance face, the secondary lock face being a flat plane which slopes rearward and downward relative to the upper secondary drive face to resist inadvertent disengagement of the nut form a secondary drive position.

9. The wench of claim 1, further comprising:

a ring portion which joins a forward end of the upper secondary drive face with a forward end of the catch face.

10. The wrench of claim 9, wherein:

the end of the end of the lower jaw terminates in a lower end face that extends at an angle downward from the catch face.

11. The wrench of claim 1, further comprising:

a flat upper forward stop face that joins and extends forward from the upper secondary drive face, the upper forward stop face is adapted to generally coextend along the first side of the nut when the wrench is in the secondary drive position; and a concave box end face joining the upper forward stop face and the catch face, the box end face adapted to generally coextend along and be spaced apart from a side of the nut adjacent to the first side when the wrench is in the secondary drive position.

12. The wrench of claim 1, wherein:

the end of the upper jaw terminates in an end face that extends at an angle upward from the upper drive face.

13. A ratcheting-type wrench for use in driving a hexagonal nut, the wrench comprising:

a wrench head having upper and lower jaw portions that are rigidly joined together, the jaw portions being immovable and adapted to accept a hexagonal nut;

an upper primary drive face located on the upper jaw portion, the upper primary drive face being a convex arcuate surface for contacting a first side of the nut when the wrench is in a primary drive position;

an upper backstop face that adjoins the upper primary drive face, the upper backstop face having a convex arcuate surface for contacting a second side of the nut adjacent to the first side when the wrench is in the primary drive position, the upper backstop face adapted to coextend generally along the length of said second side of the nut when in the primary drive position, and wherein the arcuate contact surface of the upper backstop face has an apex located at a position above the midpoint of the upper backstop face;

a lower backstop face that adjoins the upper backstop face and is adapted to generally coextend along a third side of the nut adjacent to the second side, the lower backstop face adapted to be spaced apart from the third side of the nut when the wrench is in the primary drive position;

a lower jaw face that adjoins the lower backstop face, the lower jaw face generally coextending along an opposite side of the nut from the first side when the wrench is in the primary drive position, the lower jaw face having a lower primary drive face that is a convex arcuate surface for contacting said opposite side of the nut when in the primary drive position;

a notch that adjoins the lower jaw face forward of the lower primary drive face for engaging a corner of the nut while in the primary drive position to resist inadvertent disengagement of the wrench from the nut while torque is being applied in a primary drive position, the notch having an arcuate curved surface to allow ratcheting of the wrench on the nut;

a clearance face located on the upper jaw portion forward of the upper primary drive face, the clearance face being concave to clear a corner of the nut when the wrench is being ratcheted on the nut;

an upper secondary drive face located on the upper jaw portion forward of the clearance face, the upper secondary drive face being a convex arcuate surface for contacting a first side of the nut when the wrench is in the secondary drive position;

a lower secondary drive face located on the lower jaw portion forward of the notch, the lower secondary drive face being a convex arcuate surface for contacting an opposite side of the nut from the first side when the wrench is in the secondary drive position; and a catch face located on the lower jaw portion forward of the secondary drive face, the catch face being a flat surface for contacting a nut side opposed to the second nut side when the wrench is in the secondary drive position.

14. The wrench of claim 13, wherein:

the lower drive face is convex, arcuate, and has an apex; and the notch has a forward portion that slopes upward generally at an angle of less than about 20° relative to a line tangent to the apex of the lower drive face.

15. The wrench of claim 13, wherein:

the lower jaw face has a rearward portion that joins the lower primary drive face and which is a slide face that is inclining downward relative to an axis bisecting the upper and lower jaw portions.

16. The wrench of claim 13, further comprising:

a ring portion which joins a forward end of the upper secondary drive face with a forward end of the catch face.

17. The wrench of claim 13, further comprising:

a flat upper forward stop face that joins and extends forward from the upper secondary drive face, the upper forward stop face adapted to generally coextend along the first side of the nut when the wrench is in the secondary drive position; and a concave box end face joining the upper forward stop face and the catch face, the box end face adapted to generally coextend along and be spaced apart from a side of the nut adjacent to the first side when the wrench is in the secondary drive position.

18. The wrench of claim 13, wherein:

the end of the upper jaw terminates in an end face that extends at an angle upward from the upper drive face.

19. The wrench of claim 18, wherein:

the end of the lower jaw terminates in a lower end face that extends at an angle downward from the catch face.

* * * * *